US012577741B2

(12) United States Patent
Schwarz

(10) Patent No.: US 12,577,741 B2
(45) Date of Patent: Mar. 17, 2026

(54) SLIPFORM PAVER

(71) Applicant: Wirtgen GmbH, Windhagen (DE)

(72) Inventor: Michael Schwarz, Bad Honnef (DE)

(73) Assignee: Wirtgen GmbH, Windhagen (DE)

( * ) Notice: Subject to any disclaimer, the term of this patent is extended or adjusted under 35 U.S.C. 154(b) by 755 days.

(21) Appl. No.: 18/063,171

(22) Filed: Dec. 8, 2022

(65) Prior Publication Data

US 2023/0203762 A1 Jun. 29, 2023

(30) Foreign Application Priority Data

Dec. 23, 2021 (DE) ..... 10 2021 134 452.2

(51) Int. Cl.
*E01C 19/42* (2006.01)
*E01C 19/43* (2006.01)

(52) U.S. Cl.
CPC ..... *E01C 19/42* (2013.01); *E01C 19/43* (2013.01)

(58) Field of Classification Search
CPC ..... E01C 19/42; E01C 19/43
(Continued)

(56) References Cited

U.S. PATENT DOCUMENTS 3,970,405 A * 7/1976 Swisher, Jr. ..... E01C 19/407 404/105
6,386,793 B1 5/2002 Lenz et al.
(Continued)

FOREIGN PATENT DOCUMENTS

DE 29924218 U1 6/2002
EP 1024228 A2 8/2000
(Continued)

OTHER PUBLICATIONS

European Search Report for corresponding patent application No. No. 22211768.1, dated May 25, 2023, 5 pages (not prior art).

*Primary Examiner* — Raymond W Addie
(74) *Attorney, Agent, or Firm* — Lucian Wayne Beavers; Patterson Intellectual Property Law, PC

(57) ABSTRACT

The road construction machine according to the invention, in particular a slipform paver or curing machine for freshly manufactured concrete layers, has a machine frame 1 supported by running gears 3A, 3B, 4A, 4B, on which machine frame a working device 11 is provided, which has a working means 18 that can be moved in a direction running transversely to the working direction I, which working means is fastened to a carriage 13 which is guided on a linear guide 12 running transversely to the working direction. The carriage 13 is connected to a cable 15 that is deflected on one longitudinal side of the machine frame, the free ends of which are fastened to the cable drum 19 of a cable winch 16 on the other longitudinal side of the machine frame in such a way that the carriage can be moved in the transverse direction by rotating the cable drum. The road construction machine is characterised in that the cable drum 19 has a first and a second drum half 20, 21, one end of the cable 15 being fastened to one drum half 20 and the other end of the cable being fastened to the other drum half 21. The cable winch 16 can assume a first operating mode in which the first and second drum halves 20, 21 are connected to one another in such a way that the carriage 13 is moved by rotating the first and/or second drum half. The cable winch 16 can assume a second operating mode in which the first and second drum halves 20, 21 can be rotated in opposite directions at least in one direction of rotation, so that the cable tension can be adjusted by rotating one drum half relative to the other drum half.

16 Claims, 6 Drawing Sheets

(58) Field of Classification Search
USPC ..... 404/75, 105
See application file for complete search history.

(56) References Cited

U.S. PATENT DOCUMENTS

| | | | | |
|---|---|---|---|---|
| 6,422,785 | B1 * | 7/2002 | Ruggles | E01C 19/182 404/101 |
| 6,471,442 | B1 | 10/2002 | Deeb et al. | |
| 7,311,465 | B2 * | 12/2007 | Guntert, Jr. | E01C 19/42 404/101 |
| 9,399,842 | B2 | 7/2016 | Thieme et al. | |
| 2003/0185626 | A1 | 10/2003 | Aeschlimann et al. | |

FOREIGN PATENT DOCUMENTS

| | | | |
|---|---|---|---|
| EP | 1068397 | B1 | 8/2004 |
| EP | 2886717 | A1 | 6/2015 |
| WO | 02101150 | A1 | 12/2002 |

* cited by examiner

SLIPFORM PAVER

CROSS-REFERENCES TO RELATED APPLICATIONS

This application claims the benefit of German Patent Application No. DE 10 2021 134 452.2 filed Dec. 23, 2021, which is hereby incorporated by reference.

BACKGROUND OF THE DISCLOSURE

Field of the Disclosure

The invention relates to a road construction machine, in particular to a slipform paver or a curing machine for freshly manufactured concrete layers, comprising a machine frame supported by running gears and on which a working device is provided.

Description of the Prior Art

Road construction machines include slipform pavers, which have a slipform for concrete paving. The known slipform pavers permit particularly economical concrete paving. The concrete to be paved is deposited in front of the slipform paver in the working direction. In order to distribute the concrete evenly over the entire paving width, the slipform paver has a distribution device which is arranged in front of the slipform in the working direction.

Slipform pavers are known, the distribution device of which has a pusher that can be moved transversely to the working direction and with which the concrete can be distributed in the transverse direction. The pusher, which is also referred to as a spreading plough, is fastened to a carriage which is guided on a linear guide running transversely to the working direction.

To move the carriage, traction cables fastened to the sides of the carriage can be provided, which can be wound up or unwound by means of cable winches provided on the longitudinal sides of the slipform paver, so that the carriage having the spreading plough can be moved in the transverse direction. In an alternative embodiment, the carriage can be connected to a cable that is deflected on one longitudinal side of the slipform paver, the free ends of which are fastened to the cable drum of a cable winch on the other longitudinal side of the machine frame, so that the carriage can be moved in the transverse direction by rotating the cable drum.

In order to create a particularly smooth concrete surface, the slipform pavers can also have a smoothing device that is arranged behind the slipform in the working direction. Slipform pavers are known, the smoothing device of which has a smoother which is fastened to a carriage which is guided on a linear guide running in the transverse direction. To move the carriage, two traction cables can again be provided, which are wound up and unwound by means of cable winches. Alternatively, only one cable winch can be provided, with the cable being deflected on one side of the slipform paver.

The known curing machines used for curing freshly manufactured concrete layers can also have such a working device having a working means that can be moved in the transverse direction. In the case of the curing machines, the working device can be a texturing device for texturing the freshly manufactured concrete, and the working means can be a brush element that can be moved in a direction running transversely to the working direction. However, the working device can also be a spraying device for spraying the freshly manufactured concrete with a liquid, the working means being a spray head that can be moved in the transverse direction for applying the liquid.

Road construction machines are known which allow different working widths to be set variably. The machine frame of these road construction machines has telescoping frame parts and/or the machine frame is designed in such a way that frame parts can be inserted into or removed from the existing machine frame to increase the working width.

EP 1 068 397 B1 (U.S. Pat. No. 6,471,442) discloses a slipform paver having a variable working width, which slipform paver has a distribution device as the working device, the working means (spreading plough) of which is moved in the transverse direction by means of two cables, which are wound up and unwound on cable winches arranged on both sides of the machine frame. EP 2 886 717 A1 (U.S. Pat. No. 9,399,842) discloses a curing machine having a working device that has a spray head as the working means.

In road construction machines that have a working device of the type described above, the problem arises of setting and maintaining the cable tension required for the proper operation of the working device. Practice has shown that the cable tension can decrease if the construction machine is not in operation for a long period of time. However, the cable tension can also decrease overnight, for example as a result of temperature changes, so that the cable has to be retensioned the next day. In addition, when the working width of the road construction machine is changed, the problem arises that the free length of the cable has to be adjusted, for which purpose the cable has to be wound up or unwound on the cable drum and the cable tension has to be adjusted again.

In the case of road construction machines that have two cable winches, the working width can be changed and the cable tension adjusted by operating the cable winches that wind or unwind the cables. The disadvantage, however, is that two separate cable winches are required for this embodiment. In an embodiment with only one cable winch, a cable clamp can be provided on the carriage to release the cable. A disadvantage, however, is the relatively large force that is required for manual tensioning of the cable. Tensioning the cable also proves to be relatively time-consuming. In addition, releasing the cable clamp and tensioning the cable requires work in a hazardous area immediately in front of the road construction machine.

SUMMARY OF THE DISCLOSURE

The object of the invention is to create a road construction machine, in particular a slipform paver or a curing machine for freshly manufactured concrete layers, which has a working device of the type described above, in which the tensioning of the cable is easier, faster, and safer.

The road construction machine according to the invention, in particular a slipform paver or curing machine for freshly manufactured concrete layers, has a machine frame supported by running gears, on which machine frame a working device is provided which has a working means that can be moved in a direction running transversely to the working direction, which working means is fastened to a carriage which is guided on a linear guide running transversely to the working direction. The carriage is connected to a cable that is deflected on one longitudinal side of the machine frame, the free ends of which are fastened to the cable drum of a cable winch on the other longitudinal side of the machine frame in such a way that the carriage can be moved in the transverse direction by rotating the cable drum. A linear guide is understood to be all components that allow the carriage to be guided in the transverse direction, for example guide rods, profile rail systems, tongue and groove systems, etc. A carriage is understood to be all components that are guided in the transverse direction. The carriage can be guided in a gliding manner or with rollers.

The road construction machine according to the invention is characterised in that the cable drum has a first and a second drum half, one end of the cable being fastened to one drum half and the other end of the cable being fastened to the other drum half. In this context, "a" cable is also understood to be a cable that is made up of a plurality of cables or pieces of cable that are connected to one another in such a way that tensile forces can be transmitted. For example, the free ends of two pieces of cable can be connected to one another by being fastened to the carriage so that they form a cable.

The cable winch is designed in such a way that the cable winch can assume a first operating mode in which the first and second drum halves are connected or coupled to one another in such a way that rotating the first and/or second drum halves in one direction or the other causes the carriage to move in one direction or in the other direction. The first operating mode corresponds to normal operation, in which the carriage having the working means is moved in the transverse direction. In this operating mode, the connection of the first and second drum halves need not be rigid. The decisive factor is that the connection allows the necessary torque to be transmitted from one drum half to the other in order to be able to move the carriage to the left or right under load during operation of the road construction machine if the drive is only on one of the two drum halves. The corresponding drum half can be driven by means of a hydraulic, pneumatic, or electromotive drive unit.

The cable winch is also designed in such a way that it can assume a second operating mode, in which the first and second drum halves can be rotated in opposite directions at least in one direction of rotation, so that the cable tension of the cable can be adjusted by rotating one drum half relative to the other drum half. To rotate one drum half relative to the other drum half, one of the two drum halves can be held in place while the other drum half is rotated. Each drum half can be driven hydraulically, pneumatically, or by an electric motor. The drive unit for the second operating mode can be the drive unit for the first operating mode. However, separate drive units can also be provided.

Consequently, in the first operating mode, the two drum halves form a "single cable drum" with which the cable can be wound up or unwound without changing the free cable length. In the second operating mode, however, the two drum halves form "two cable drums" so that the free cable length can be changed. The two drum halves can therefore also be understood as two separate cable drums which can be coupled to one another or decoupled from one another, i.e., they can be separated from one another.

One embodiment of the cable winch provides that the first drum half has at least one first connecting element and the second drum half has at least one second connecting element, the at least one first and second connecting elements being designed in such a way that in the first operating mode a non-positive connection is established between the first and second connecting elements. The connecting elements can be clutch discs, for example, which allow a non-positive connection in order to be able to transmit the torque required to move the carriage. The non-positive connection can be released in that at least one of the two drum halves is moved in the axial direction, so that the clutch discs are arranged at a distance from one another. A suitable adjustment mechanism can be provided for this purpose. This adjustment mechanism can have an adjusting screw, for example. The drum halves can also be adjusted, for example, with a piston/cylinder arrangement. However, the clutch discs can also be designed in such a way that they act as slipping clutches, but the transmittable torque is still so great that the carriage can be moved in the first operating mode and the drum halves can be rotated in opposite directions in the second operating mode. In this case, an adjustment mechanism is not required. The connecting elements can be an integral part of the drum halves or form separate components.

An alternative embodiment provides that the first drum half has at least one first connecting element and the second drum half has at least one second connecting element, the at least one first and second connecting elements being designed in such a way that in the first operating mode a positive connection is established between the first and second connecting elements. The connecting elements can have, for example, claws or external or internal teeth which are engaged in the first operating mode and disengaged in the second operating mode. In this embodiment, an adjustment mechanism for axially moving the drum halves can be provided for releasing the connecting elements.

A particularly preferred embodiment provides that the cable winch is designed in such a way that the first and second cable drum form a clutch that acts only in one direction of rotation, so that the first drum half and the second drum half can only be rotated in one direction of rotation. This direction of rotation is preferably the direction of rotation in which one drum half must be rotated when the other drum is held in place in order to tension the cable.

In the most preferred embodiment, the first drum half can have at least one locking piece and the second drum half can have at least one spring-biased pawl, the at least one pawl being engaged in the at least one locking piece in a locking manner. The two drum halves can be rotated relative to one another to tension the cable, with the locking effect in one direction of rotation facilitating tensioning because the cable system remains under the set pretension. The required torque can be easily transmitted in one direction of rotation. Torque transmission in the other direction of rotation, i.e., counter to the locking effect, can be made possible by rigidly connecting the two drum halves to one another. The rigid connection can be made, for example, with a screw or a bolt or other locking elements that can be actuated electromagnetically, hydraulically, or pneumatically. However, locking is not necessary if the freewheel is designed such that, for example, the spring preload of the pawl is dimensioned such that the two drum halves are still held together in the other direction of rotation to such an extent that the required torque is transmitted.

The first drum half may have a plurality of locking pieces circumferentially distributed around an axis of rotation of one of the two drum halves at predetermined intervals, and the other of the two drum halves may have a plurality of pawls distributed circumferentially around an axis of rotation of the drum half at predetermined intervals. This makes it possible to connect one drum half to the other drum half in different intermediate positions. A particularly large number of intermediate positions can be achieved in that the predetermined intervals at which the locking pieces of one of the two drum halves are arranged and the predetermined intervals at which the pawls of the other of the two drum halves are arranged are matched to one another in the manner of a nonius.

In order to completely separate the first drum half and the second drum half, the two drum halves can, in the particularly preferred embodiment, be axially displaceable in relation to one another between a first position, in which the at least one pawl engages in the at least one locking piece, and a second position, in which the at least one pawl does not engage in at least one locking piece. If both drum halves are completely separated from one another, the cable can be wound up or unwound from one or both cable drums if the working width is increased or decreased. A suitable adjustment mechanism can be provided for the axial displacement of the drum halves. This adjustment mechanism can have an adjusting screw, for example. However, the drum halves can also be adjusted, for example, with a piston/cylinder arrangement.

For tensioning or for winding or unwinding the cable, only a movement of the drum halves relative to one another is required. For this purpose, both drum halves or only one of the two drum halves can be rotated, it being possible for only one rotary drive to be provided on one side or for rotary drives to be provided on both sides of the cable drum. Preferably, only one rotary drive is provided for driving the first drum half, which can be arranged on the inside facing the machine frame. The rotary drive can thus be fastened to the machine frame.

A further embodiment provides a locking device which is designed in such a way that one of the two drum halves can be locked in relation to the machine frame. If only one of the two drum halves is to be driven, the second drum half can be locked by means of the locking device.

The locking device can comprise a perforated body on one of the two drum halves with holes arranged circumferentially around the axis of rotation of the drum half and a stationary frame assigned to the drum half with a bore, so that a bolt for locking the drum half can be pushed through the bore of the frame into one of the holes. However, the locking can also take place by means of other locking devices, for example by means of a braking device acting on the cable drum or its drum half.

The road construction machine can be a slipform paver, the machine frame of which has a right-hand frame part running in the working direction and a left-hand frame part running in the working direction, between which a slipform is arranged, the working device being a distribution device arranged in the working direction in front of the slipform for distributing the concrete to be paved in a direction running transversely to the working direction, the working means being a pusher that can be moved in the transverse direction.

The road construction machine can also be a slipform paver, the machine frame of which has a right-hand frame part running in the working direction and a left-hand frame part running in the working direction, between which a slipform is arranged, the working device being a smoothing device arranged behind the slipform in the working direction for smoothing the freshly manufactured concrete, and the working means being a smoother movable in a direction extending transversely to the working direction.

In addition, the road construction machine can also be a curing machine for freshly manufactured concrete layers, the working device being a texturing device for texturing the freshly manufactured concrete, and the working means being a brush element that can be moved in a direction running transversely to the working direction, or the working device being a spraying device for spraying the freshly manufactured concrete with a liquid, the working means being a spray head which can be moved in a direction transverse to the working direction.

The advantages of the invention come into play in particular when the machine frame of the road construction machine and the linear guide of the working device are designed for the variable setting of different working widths, so that there is not only the problem of setting the cable tension but also of adjusting the free cable length to the different working widths. The required cable tension can be established quickly and easily by rotating one or both drum halves. The cable supply can be distributed over both drum halves. It is particularly advantageous if the supply of cable is not equally distributed over the two drum halves, but rather the majority of the supply of cable is on one of the drum halves. The cable can be tightened outside the danger area on one side of the road construction machine. The cable can be re-tensioned manually on one side only or with a single rotary drive on one side only. With suitable drive units and adjustment mechanisms, the tensioning of the cable and the setting of the appropriate free cable length can also be partially or fully automated.

BRIEF DESCRIPTION OF THE DRAWINGS

Embodiments of the invention are described in detail below with reference to the drawings, in which:

FIG. 1 shows a highly simplified schematic representation of a slipform paver as an example of a self-propelled construction machine.

DETAILED DESCRIPTION

Figure 1:
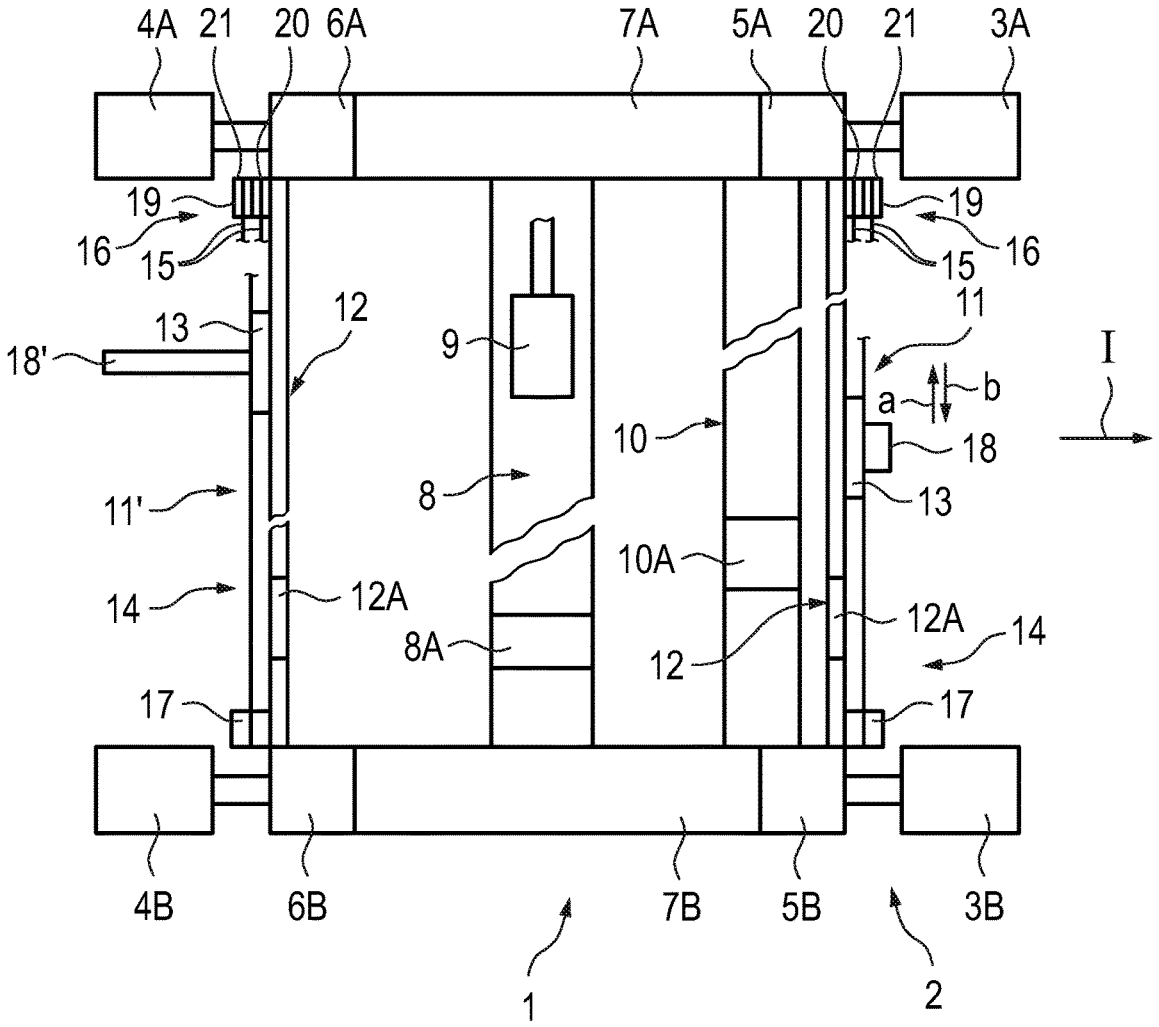
FIG. 1 is a plan view of a schematic representation of a slipform paver having a variable working width as an example of a road construction machine, which slipform paver has a front and rear working device in the working direction.

The slipform paver has a machine frame 1 which is supported by a chassis 2. The chassis 2 comprises, in the working direction I, a front, left chain drive 3A and a front, right chain drive 3B and, in the working direction, a rear left chain drive 4A and a rear right chain drive 4B. The chain drives are fastened to the machine frame by means of front left and right lifting devices 5A, 5B and rear left and right lifting devices 6A, 6B. The chain drives may also be referred to as crawler tracks. Wheels may also be used instead of crawler tracks. The crawler tracks or wheels may also be referred to as running gears.

The machine frame 1 comprises, in the working direction I, a left frame part 7A, a right frame part 7B, and a middle frame part 8. The middle frame part 8 can be lengthened or shortened to change the working width of the slipform paver. For this purpose, piston/cylinder arrangements 9 that are only indicated in outline can be provided, or individual frame pieces 8A can be inserted into or removed from the central frame part 8. The machine frame 1 may be described as having first and second longitudinal frame sides defined by the left and right frame parts 7A and 7B.

Between the outer frame parts 7A, 7B, a slipform 10 running transversely to the working direction is arranged for producing a concrete layer for a roadway. The slipform 10 also has a variable working width, for example by inserting and removing individual slipform segments 10A.

In addition, the slipform paver comprises a front working device 11 in the working direction I, which is arranged in front of the slipform 10, and a rear working device 11' in the working direction I, which is arranged behind the slipform in the working direction.

The front and rear working devices 11, 11' each comprise a longitudinal guide 12 running transversely to the working direction, on which a carriage 13 is guided in the transverse direction, and a cable system 14 for moving the carriage. The same reference signs are used for the parts of the working device that correspond to one another. The working width of the longitudinal guide 12 can also be changed by inserting and removing longitudinal guide parts 12A. The cable system 14 of the two working devices has a cable 15 running in the transverse direction, which is wound up or unwound by means of a cable winch 16 on the left in the working direction I and is deflected on a deflection roller 17 on the right in the working direction I. The deflection roller 17 may also be referred to as a deflector 17. The carriage 13 is fastened to the cable 15. A working means 18, 18' is fastened to the carriage 13. The working means 18, 18' may also be referred to as a working tool 18, 18'.

If the working width of the slipform paver is changed, the width of the working device 11, 11' must be adjusted. To do this, the free cable length of the cable system 14 must be changed. In addition, the cable 15 must be tensioned or re-tensioned for the cable system 14 to function properly. The structure and the function of the cable system 14 are described in detail below.

The front working device 11 is a distribution device for distributing the concrete to be paved in a direction running transversely to the working direction over the entire working width, with the working means 18 being a pusher, which is also referred to as a spreading plough. The rear working device 11' is a smoothing device for smoothing the freshly manufactured concrete, and the working means 18' is a smoother.

Figure 2:
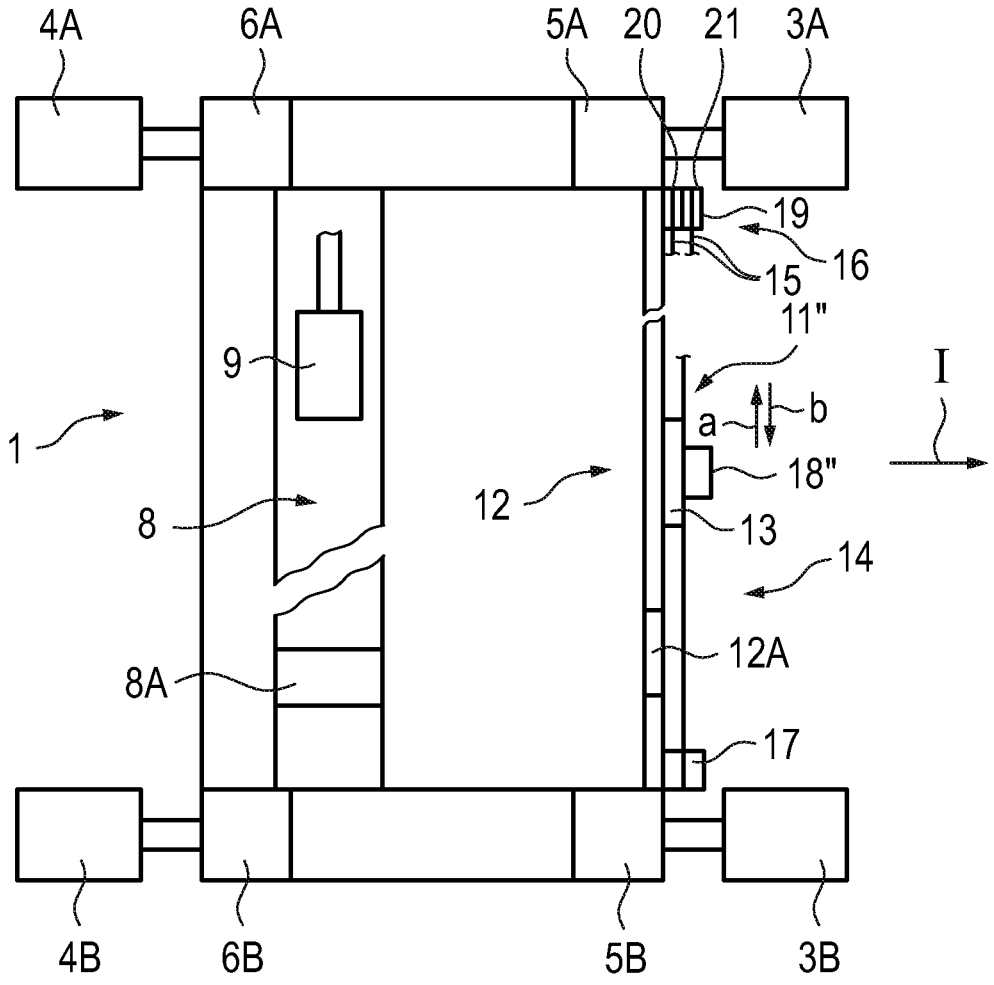
FIG. 2 is a plan view of a schematic representation of a curing machine for freshly manufactured concrete layers having a variable working width as an example of a road construction machine, which has a working device.

FIG. 2 shows a curing machine for freshly manufactured concrete layers as an example of a self-propelled construction machine having a working device. The components corresponding to the slipform paver are denoted by the same reference signs. In the case of the curing machine, the working device 11" can be a texturing device for texturing the freshly manufactured concrete, with the working means 18" being a brush element that can be moved in a direction running transversely to the working direction I. However, the working device 11" can also be a spraying device for spraying the freshly manufactured concrete with a liquid, the working means 18" being a spray head that can be moved in the transverse direction.

Figure 3A:
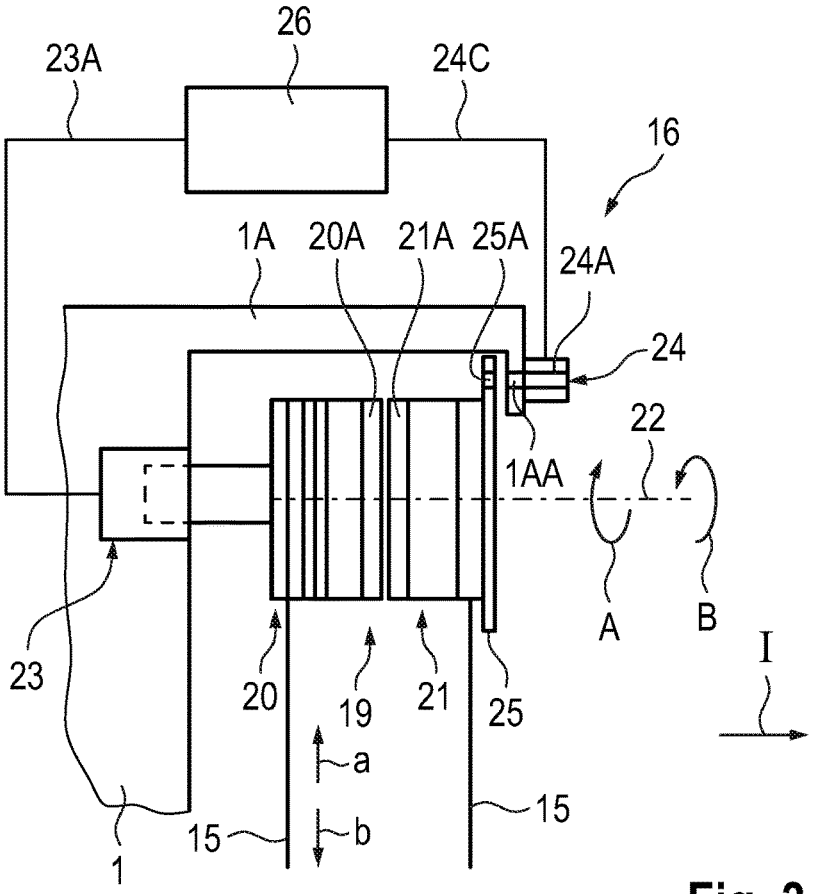
FIGS. 3A, 3B, and 3C are schematic representations of a first embodiment of the cable winch of the working device to illustrate the functional principle.
Figure 3B:
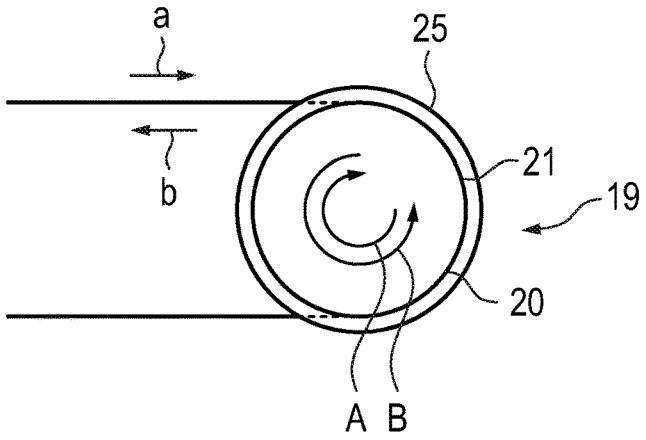
Figure 3C:
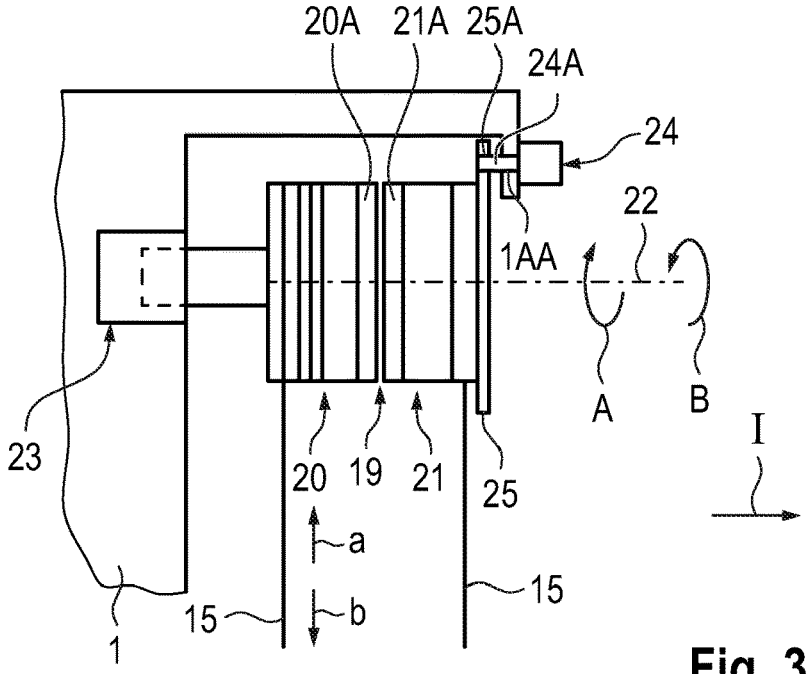

FIGS. 3A, 3B, and 3C show a first embodiment of the cable winch 16 of the cable system 14 in a simplified schematic representation. The cable winch 16 has a cable drum 19 which comprises a first and a second drum half 20, 21. The first and second drum halves 20, 21 are fastened to the machine frame 1 such that they can rotate about a common axis of rotation 22. FIG. 3A shows the cable winch 16 in the first mode of operation, and FIG. 3C shows the cable winch in the second operating mode. FIG. 3B shows a view of the end face of the cable drum 19 from a direction opposite to the working direction I.

The first drum half 19 is driven by means of a drive unit 23 which is provided on the machine frame 1. The drive unit 23 can have a hydraulic motor or an electric motor, for example. The drive unit 23 can also be referred to as a drive motor 23.

The first and second drum halves 20, 21 each have a connecting element 20A, 21A on the end faces, which in the present embodiment is a clutch disc having a clutch lining. The two drum halves 20, 21 are resiliently prestressed against one another in the axial direction, as a result of which the clutch discs are pressed against one another. The torque that can be transmitted with the clutch discs is sufficient to be able to transmit the carriage 13 during operation of the road construction machine. The torque that can be transmitted is determined by the design of the clutch discs and the contact pressure.

The free ends of the cable 15 deflected on the deflection roller 17 are fastened to the cable drum 19 in opposite directions. The free end of the upper piece of cable (FIG. 3B) is fastened to the first drum half 20 (FIG. 3A), and the free end of the lower piece of cable (FIG. 3B) is fastened to the second drum half 21 (FIG. 3A), so that, when the cable drum 19 rotates clockwise A (viewed from the plan view of the cable drum from a direction opposite to the working direction I), the incoming, upper piece of cable is wound onto the first drum half 20 and the outgoing, lower piece of cable is unwound from the second drum half 21. Consequently, the carriage 13 fastened to the upper piece of cable is moved with the working means 18, 18', 18" in the direction of the arrow a (FIG. 1, FIG. 3A, FIG. 3B) from right to left (seen in the working direction) (FIG. 1). However, the carriage can also be fastened to the lower piece of cable, whereby the direction of movement is reversed. A counter-clockwise rotation of the cable drum B results in a movement of the working means in the direction of arrow b from left to right (seen in the working direction). Consequently, the working means can be moved in both directions a, b, which corresponds to the first operating mode.

To tension the cable 15, the cable winch 16 has a locking device 24 fastened to an outer frame 1A of the machine frame 1, which locking device in the present embodiment has a hydraulically, pneumatically, or electromagnetically actuated locking element 24A, for example a bolt, which can be displaced. On the outside, the second drum half 21 has a perforated body 25 with holes 25A arranged circumferentially around its axis of rotation 22, into which the locking element 24A, which can be pushed forward through a bore 1AA in the frame 1A, can engage in order to attach the second drum half 21 to be locked to the stationary frame 1A. Instead of a locking device with an automatically actuable locking element, a bolt can also be pushed manually through the bore 1AA into one of the holes 25A for locking. The locking device 24 may also be referred to as a lock 24.

To set the second operating mode, the second drum half 21 is locked by means of the locking device 24 (FIG. 3C). To tension the cable 15 in the second operating mode, the first drum half 20 is rotated clockwise A by means of the drive unit 23, with the second drum half 21 being held in place. The two drum halves 20, 21 act as a slipping clutch (FIG. 3C), which corresponds to the second operating mode.

To adapt the free cable length to a reduced or increased working width, the second drum half 21 is locked and the first drum half 20 is rotated clockwise A or counter-clockwise B, which corresponds to the second operating mode.

To control the drive unit 23 and the locking device 24, a control unit 26 (FIG. 3A) is provided, which can be a component of the central control unit of the road construction machine (not shown). The drive unit 23 and the locking device 24 are connected to the control unit 26 via control lines 23A, 24C. The control unit 26 can be configured in such a way that the individual method steps for tensioning the cable or for adjusting the free cable length are carried out fully automatically.

Figure 4A:
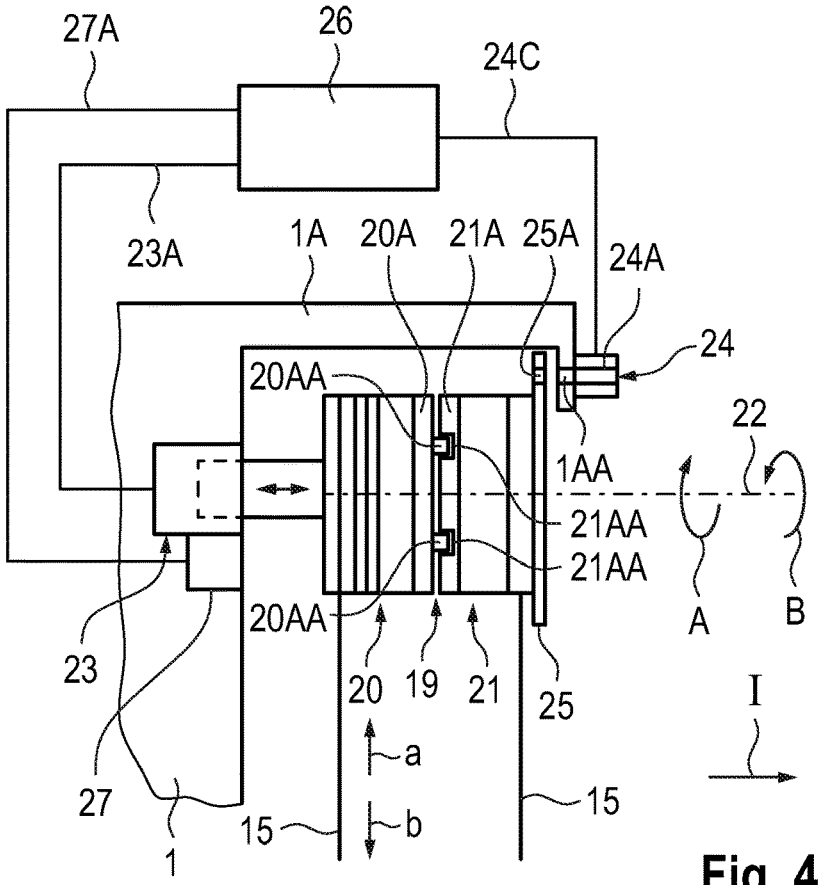
FIGS. 4A and 4B are plan views of a schematic representation of a second embodiment of the cable winch.
Figure 4B:
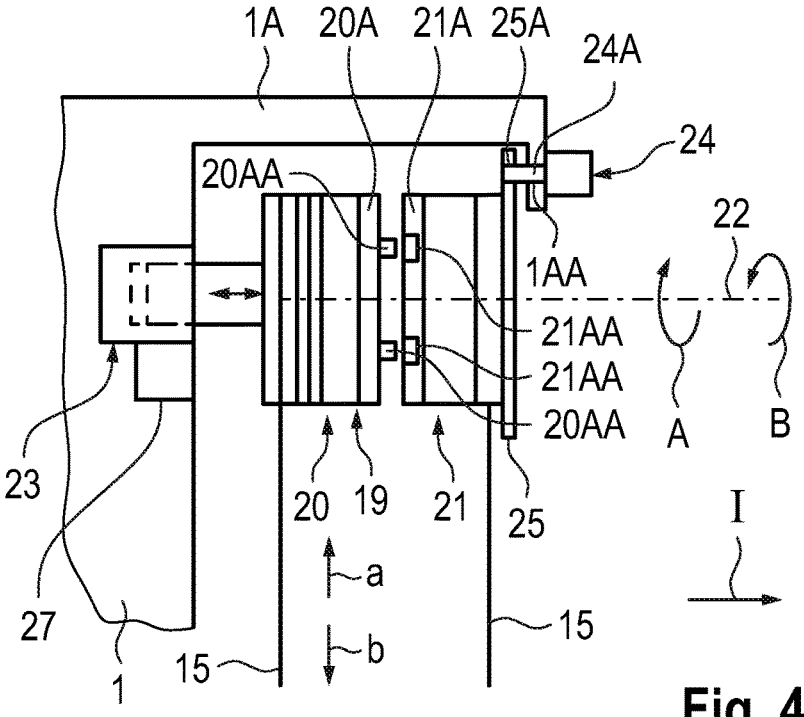

FIGS. 4A and 4B show an alternative embodiment in which the connecting elements do not produce a non-positive connection but rather a positive connection. The corresponding parts are designated with the same reference signs. In the present embodiment, the connecting element 20A of the first drum half 20 has claws 20AA (only shown in outline in FIGS. 4A and 4B) which engage in corresponding recesses 21AA provided on the second drum half 21, so that a positive connection is produced.

In the alternative embodiment, the cable winch has an adjustment device 27 which is designed in such a way that the first drum half 20 can be moved in the axial direction relative to the second drum half 21. The adjusting device 27 can comprise hydraulic, pneumatic, or electromagnetic drive means, for example a piston/cylinder arrangement, which are connected to the control unit 26 via a control line 27A. The control unit 26 can again be configured in such a way that the individual method steps for tensioning the cable or for adjusting the free cable length are carried out fully automatically. However, the adjusting device 27 can also comprise, for example, an adjusting screw that can be operated manually.

To tension the cable 15, the control unit 26 actuates the adjusting device 27 in such a way that the first cable drum 20 is moved from a first position in which the claws 20AA are engaged (FIG. 4A) in the axial direction to a second position in which the claws 20AA are disengaged (FIG. 4B). In addition, the control unit 26 actuates the locking device 24 in such a way that the second drum half 21 is locked. After locking the second drum half 21, the control unit 26 activates the drive unit 23 so that the cable 15 is wound up on the first cable drum 20 to tension it (rotational direction A is clockwise as seen from a direction opposite to the working direction I) or in the event of a change of the working width for shortening or lengthening the free cable length, the cable is wound up on the first cable drum 20 or unwound from the cable drum 20 (direction of rotation A or B). The first cable drum 20 is then moved back into the first position and the locking device 24 is released again (FIG. 4A).

Figure 5A:
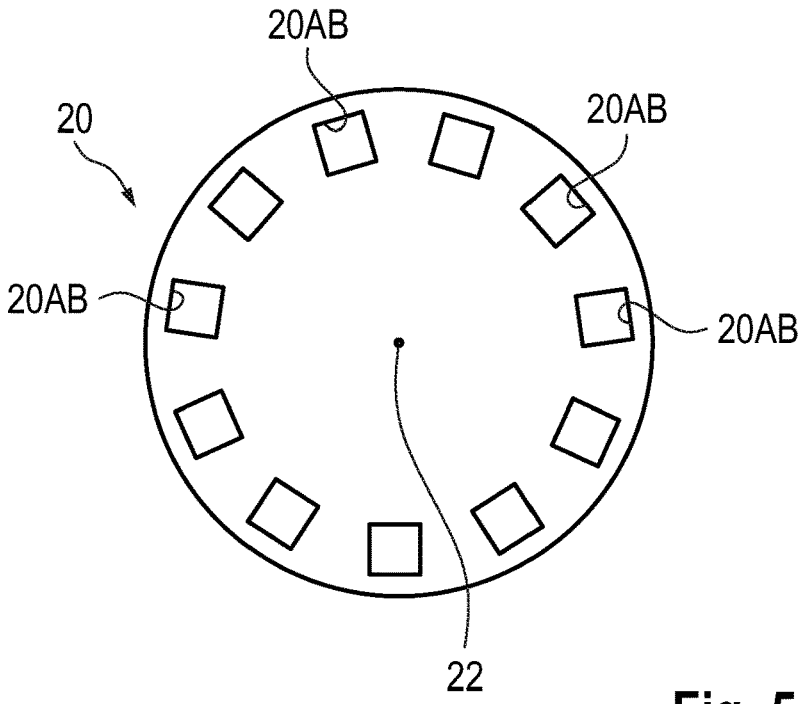
FIG. 5A shows one of the two drum halves of the cable drum of the cable winch in the plan view of a third embodiment of the cable drum.
Figure 5B:
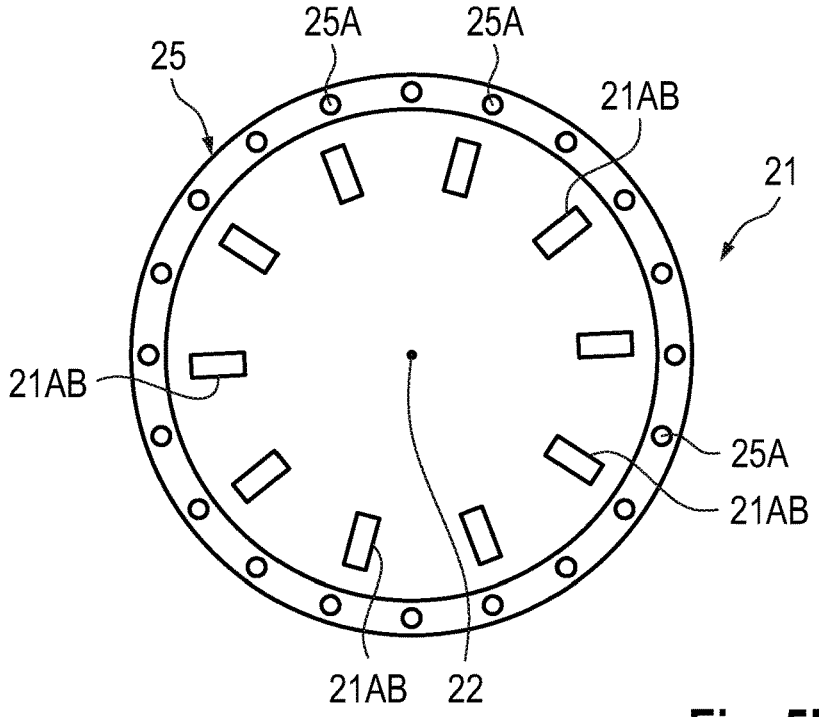
FIG. 5B is a plan view of the other of the two drum halves of the cable drum of the cable winch of the third embodiment.
Figure 5C:
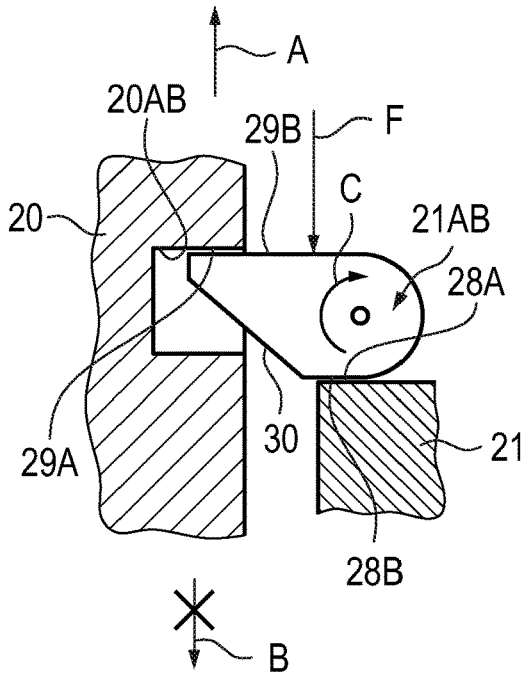
FIG. 5C shows a pawl of the cable drum of the third embodiment.

FIGS. 5A, 5B, and 5C show a further alternative embodiment in a simplified schematic representation, which differs from the embodiment of FIGS. 4A and 4B in that the cable winch 16 is designed in such a way that the first and second drum halves 20, 21 form a clutch which acts only in one direction of rotation. The construction and function of the cable winch 16 from FIGS. 5A, 5B, and 5C otherwise correspond to the embodiment from FIGS. 4A and 4B. The cable winch 16 therefore also has the drive unit 23 shown in FIGS. 4A and 4B, the locking device 24 and the adjustment device 27 as well as the control unit 26. FIG. 5A shows a plan view of the end face of the first drum half 20, while FIG. 5B shows a plan view of the end face of the second drum half 21.

On the end face of the first drum half 20, locking pieces 20AB are provided circumferentially distributed around its axis of rotation 22 at predetermined intervals (FIG. 5A). On the end face around its axis of rotation 22, the second drum half 21 has circumferentially distributed locking pawls 21AB at predetermined intervals which engage in the first position of the drum halves in the locking pieces 20AB (FIG. 5B), so that the drum halves 20, 21 form a freewheel. FIG. 5C shows one of the plurality of pawls 21AB engaging in one of the plurality of locking pieces 20AB. The pawl 21AB is spring-biased with a spring (not shown in FIG. 5C) so that a force F acts on the pawl, whereby the pawl bears with a first abutment surface 28A against a stop surface 28B on the end face of the second drum half 21 and bears with a second abutment surface 29A against a second stop surface 29B on the locking piece 20AB of the first drum half 20. When the first drum half 20 is rotated relative to the stationary second drum half 21 in the direction of arrow A, which corresponds to the direction of rotation A in FIG. 4A, the locking piece 20AB catches the pawl 21AB on its inclined surface 30, so that the pawl is rotated (freewheel) in the direction of arrow C (FIG. 5C). A rotation of the first drum half 20 in the opposite direction of rotation B (FIG. 5C) is not possible, however, since the pawl 21AB blocks rotation in this direction of rotation. Therefore, in the direction of rotation B, the torque required to move the working means 18, 18', 18" can be easily transmitted. The spring tension F can be dimensioned in such a way that, if the first cable drum 20 is driven by the drive unit 23 in the direction of rotation A and the locking device 24 releases the second cable drum 21 (first operating mode), the torque required to move the working means in both directions (left and right) can be transmitted without "the clutch slipping."

To tension the cable 15 or to shorten the free cable length, the second drum half 21 is locked, with the first drum half 20 being rotated in the direction of rotation A. The predetermined intervals at which the locking pieces 20AB of one of the two drum halves 20 are arranged and the predetermined intervals at which the pawls 21AB of the other of the two drum halves 21 are arranged are matched to one another in the manner of a nonius. This creates a large number of locking positions, so that the cable tension can be adjusted in relatively small steps.

However, when the first drum half 20 is in the first position, the free cable length cannot be extended because the "clutch is engaged" (see FIG. 4A). In order to lengthen the free cable length, the first drum half 20 is moved into the second position by means of the adjustment device 27, in which the pawls 21AB are disengaged (cf. FIG. 4B). The first drum half 20 is then rotated in the direction of rotation B so that the cable 15 can unwind from the first drum half 20. For this purpose, the second drum half 21 does not need to be locked.

The invention claimed is:

1. A road construction machine, comprising:

a machine frame having first and second longitudinal frame sides and having a working direction;

a plurality of wheels or tracks supporting the machine frame;

a linear guide running transversely to the working direction;

a carriage guided on the linear guide;

a working tool fastened to the carriage so that the working tool is movable in a direction running transversely to the working direction;

a deflector located on the machine frame closer to one of the first and second longitudinal frame sides;

a cable winch including a cable drum located on the machine frame closer to the other of the first and second longitudinal frame sides, the cable drum including a first drum half and a second drum half;

a cable extending about the deflector and including first and second free ends fastened to the first and second drum halves, respectively; and wherein the cable winch is configured such that the cable winch can assume either of:

a first operating mode in which the first and second drum halves are connected to one another such that rotating the first and/or second drum halves in one direction or the other causes the carriage to move in one direction or the other; and a second operating mode in which the first and second drum halves can be rotated in opposite directions at least in one direction of rotation, so that a cable tension of the cable can be adjusted by rotating one drum half relative to the other drum half.

2. The road construction machine of claim 1, wherein:

the first drum half includes at least one first connecting element and the second drum half includes at least one second connecting element, the at least one first and second connecting elements being configured such that in the first operating mode a non-positive connection is established between the at least one first and second connecting elements.

3. The road construction machine of claim 1, wherein:

the first drum half includes at least one first connecting element and the second drum half includes at least one second connecting element, the at least one first and second connecting elements being configured such that in the first operating mode a positive connection is established between the at least one first and second connecting elements.

4. The road construction machine of claim 1, wherein:

the cable winch includes a drive motor for driving one of the first and second drum halves.

5. The road construction machine of claim 1, the road construction machine being a slipform paver, wherein:

the machine frame includes a right-hand frame part running in the working direction and a left-hand frame part running in the working direction;

the road construction machine further includes a slipform arranged between the right-hand frame part and the left-hand frame part; and the working tool is a pusher arranged in front of the slipform for distributing concrete to be paved in the direction running transversely to the working direction.

6. The road construction machine of claim 1, the road construction machine being a slipform paver, wherein:

the machine frame includes a right-hand frame part running in the working direction and a left-hand frame part running in the working direction;

the road construction machine further includes a slipform arranged between the right-hand frame part and the left-hand frame part; and the working tool is a smoothing tool arranged behind the slipform for smoothing freshly poured concrete, the smoothing tool being movable in the direction extending transversely to the working direction.

7. The road construction machine of claim 1, the road construction machine being a curing machine for curing freshly poured concrete, wherein:

the working tool is a brush that can be moved in the direction transversely to the working direction for texturing the freshly poured concrete.

8. The road construction machine of claim 1, the road construction machine being a curing machine for curing freshly poured concrete, wherein:

the working tool is a spray head that can be moved in the direction transversely to the working direction for spraying the freshly poured concrete with a liquid.

9. The road construction machine of claim 1, wherein:

the machine frame and the linear guide are configured for variable setting of different working widths.

10. The road construction machine of claim 1, wherein:

the cable winch is configured such that the first and second drum halves form a clutch which acts only in one direction of rotation.

11. The road construction machine of claim 10, wherein:

one of the first and second drum halves includes at least one locking piece and the other of the first and second drum halves includes at least one spring-loaded locking pawl, the at least one pawl engaging in the at least one locking piece.

12. The road construction machine of claim 11, wherein:

the first drum half and the second drum half are axially displaceable relative to each other between a first position in which the at least one pawl engages the at least one locking piece, and a second position in which the at least one pawl is disengaged from the at least one locking piece.

13. The road construction machine of claim 11, wherein:

the one of the first and second drum halves includes a plurality of the locking pieces arranged circumferentially distributed about an axis of rotation of the one of the first and second drum halves at predetermined intervals, and the other of the first and second drum halves includes a plurality of the pawls distributed circumferentially about an axis of rotation of the other of the first and second drum halves at predetermined intervals.

14. The road construction machine of claim 13, wherein:

the predetermined intervals at which the locking pieces of the one of the first and second drum halves are arranged and the predetermined intervals at which the pawls of the other of the first and second drum halves are arranged are matched to one another so that the drum halves can assume a variety of locking positions.

15. The road construction machine of claim 1, wherein:

the cable winch includes a lock configured such that one of the first and second drum halves can be locked in relation to the machine frame.

16. The road construction machine of claim 15, wherein:

the lock includes a perforated body provided on the one of the first and second drum halves, the perforated body including a plurality of holes arranged circumferentially around an axis of rotation of the one of the first and second drum halves, and the lock includes a stationary frame including a bore configured such that a locking element can be pushed through the bore of the stationary frame into one of the holes of the perforated body.

* * * * *